US006578797B2

(12) United States Patent
Fischer

(10) Patent No.: US 6,578,797 B2
(45) Date of Patent: Jun. 17, 2003

(54) KITE ALTITUDE MEASURING APPARATUS

(76) Inventor: David C. Fischer, 11 Upland Dr., Chappaqua, NY (US) 10514

( * ) Notice: Subject to any disclaimer, the term of this patent is extended or adjusted under 35 U.S.C. 154(b) by 145 days.

(21) Appl. No.: 09/922,212

(22) Filed: Aug. 6, 2001

(65) Prior Publication Data

US 2003/0025039 A1 Feb. 6, 2003

(51) Int. Cl.[7] ..... B64C 31/06
(52) U.S. Cl. ..... 244/155 R; 244/155 A; 33/1 N
(58) Field of Search ..... 244/155 A, 155 R, 244/153 R; 33/701, 707, 1 N, 1 PT, 534; 73/865.9

(56) References Cited

U.S. PATENT DOCUMENTS 2,388,478 A * 11/1945 Garber
5,131,165 A * 7/1992 Benson
5,180,123 A * 1/1993 Lin
5,277,350 A * 1/1994 Thornbury
5,493,786 A * 2/1996 Thomson
6,253,461 B1 * 7/2001 Fischer

* cited by examiner

*Primary Examiner*—Tien Dinh
(74) *Attorney, Agent, or Firm*—Marvin Gordon

(57) ABSTRACT

An apparatus for measuring and displaying the altitude of a kite in the air includes a device for measuring the length of the kite line that has been unwound from the reel and a device that produces a signal to a microprocessor that represents the angle the kite line makes with the horizontal. The height of the kite, which is computed from the measured line length and angle, is displayed.

5 Claims, 2 Drawing Sheets

KITE ALTITUDE MEASURING APPARATUS

FIELD OF THE INVENTION

The present invention relates generally to altitude-measuring devices, and more particularly to an apparatus for measuring and displaying the altitude of a kite when it is in the air.

BACKGROUND OF THE INVENTION

People around the world have flown kites since time immemorial. Although kites have been occasionally used for meteorological and military use, the flying of kites is usually done by people of all ages for their pleasure and enjoyment. Kites, which vary widely in size and shape, commonly include a light frame typically made of strips of wood covered with paper or cloth. A long cord or string is attached to one end of the frame. The other end of the cord is wound on a bobbin, reel or the like which is held in the operator's hand.

Kites are typically formed in the shape of a diamond or a box and one or more tails usually made of cloth is appended to one end of the kite for balancing purposes. When the kite is to be flown, the kite is released and the operator holding the reel in his or her hand runs along the ground until the kite begins to rise into the air. By pulling on the string the operator is able to maneuver the kite and to control the height or attitude to which it ascends.

In recent years, attempts have been made to design kites so as to increase the altitudes to which they are able to rise. As these heights have increased, as a result of these new designs, as well as through the use of new, lighter-weight materials in kite construction, so has the interest in measuring the altitude of a kite. For example, the person flying a kite may be interested in knowing how high the kite has risen both as a matter of intellectual curiosity and as an indication of the quality of the kite and, particularly in kite-flying competitions, of his or her skill in kite flying.

The task of determining the altitude attained by a kite is complicated by the fact that a kite rarely if ever rises vertically from the ground, but rather extends upwards at some acute angle with respect to the horizontal. Thus merely measuring the length of string unwound from the reel as the kite rises to its current position would not provide an indication of the altitude of the kite. There thus exists a need for an apparatus that is able to reliably measure the height or altitude of a kite on a continuing, real-time basis with an apparatus which is economical, light in weight and convenient to use.

SUMMARY OF THE INVENTION

The kite altitude-measuring apparatus of the present invention measures the length of line unwound from the reel as well as the angle that the line and thus the kite makes with respect to the horizontal (or vertical). In accordance with the invention, the line is passed through a pivotable member that moves along an arcuate path with respect to a stationary angle sensor. The latter is effective to address a memory containing address locations in which the sines of the angles along the arcuate path through which the pivotable member moves so as to provide the appropriate angle sine data to a microprocessor. The sine of the measured angle of the pivotable member and thus of the kite itself is multiplied in the microprocessor by the measured length of the paid out line to develop a signal that represents the altitude of the kite.

In an embodiment of the invention herein disclosed, the kite line passes through the interior of a pivotable tubular member, which, in accordance with the number of axially spaced conductive segments on the line that pass therethrough, produces an electrical signal that represents the length of the line unwound from the reel as the kite rises to its current position. The tubular member is mounted so that it can pivot about an axis to the angle made by the paid out line with respect to the horizontal.

In another aspect of the invention, a plurality of angularly spaced contacts mounted on the angle sensor are positioned near the end of the pivotable tubular member such that a contact at one end of the tubular member makes contact with one of the spaced contacts on the angle sensor in accordance with the angular orientation of the tubular member and thus of the kite. Each of the spaced contacts may be, as herein disclosed, associated uniquely with an address in the memory that stores the sine of the angle associated with that contact and thus with the angle of the tubular member with which it is then in contact.

BRIEF DESCRIPTION OF THE DRAWINGS

To the accomplishment of the above and such further objects as may hereinafter appear, the present invention relates to a kite altitude-measuring apparatus substantially as defined in the appended claims and as described in the following detailed specification considered with the accompanying drawings, in which:

DETAILED DESCRIPTION OF THE PREFERRED EMBODIMENT

Figure 1:
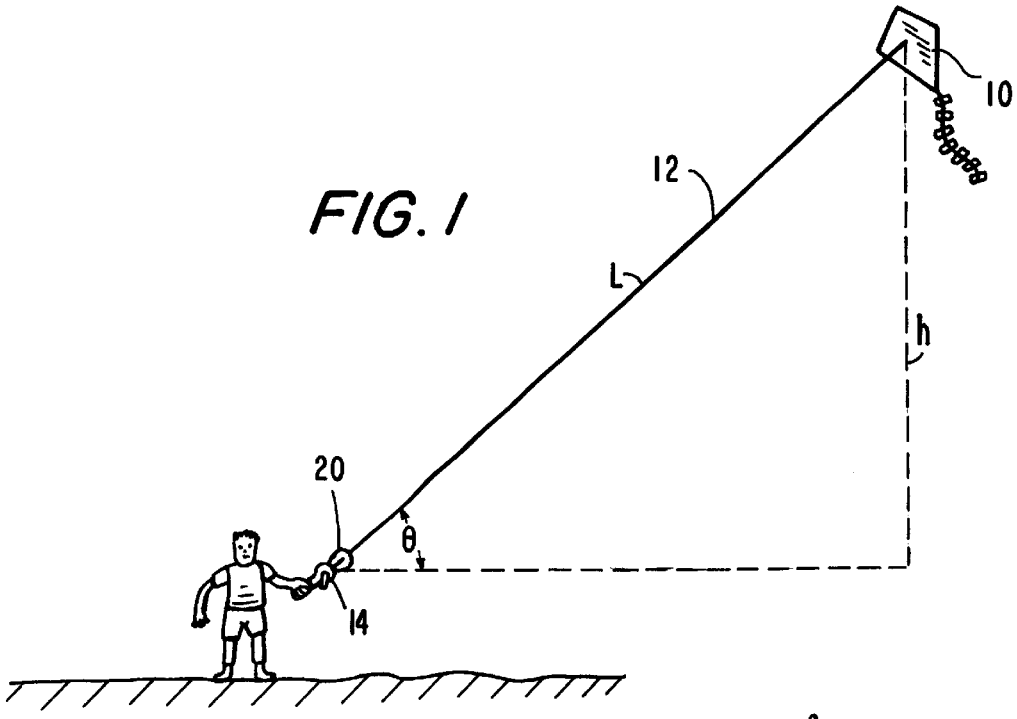
FIG. 1 is a schematic diagram illustrating the operating principles of the present invention.
Figure 3:
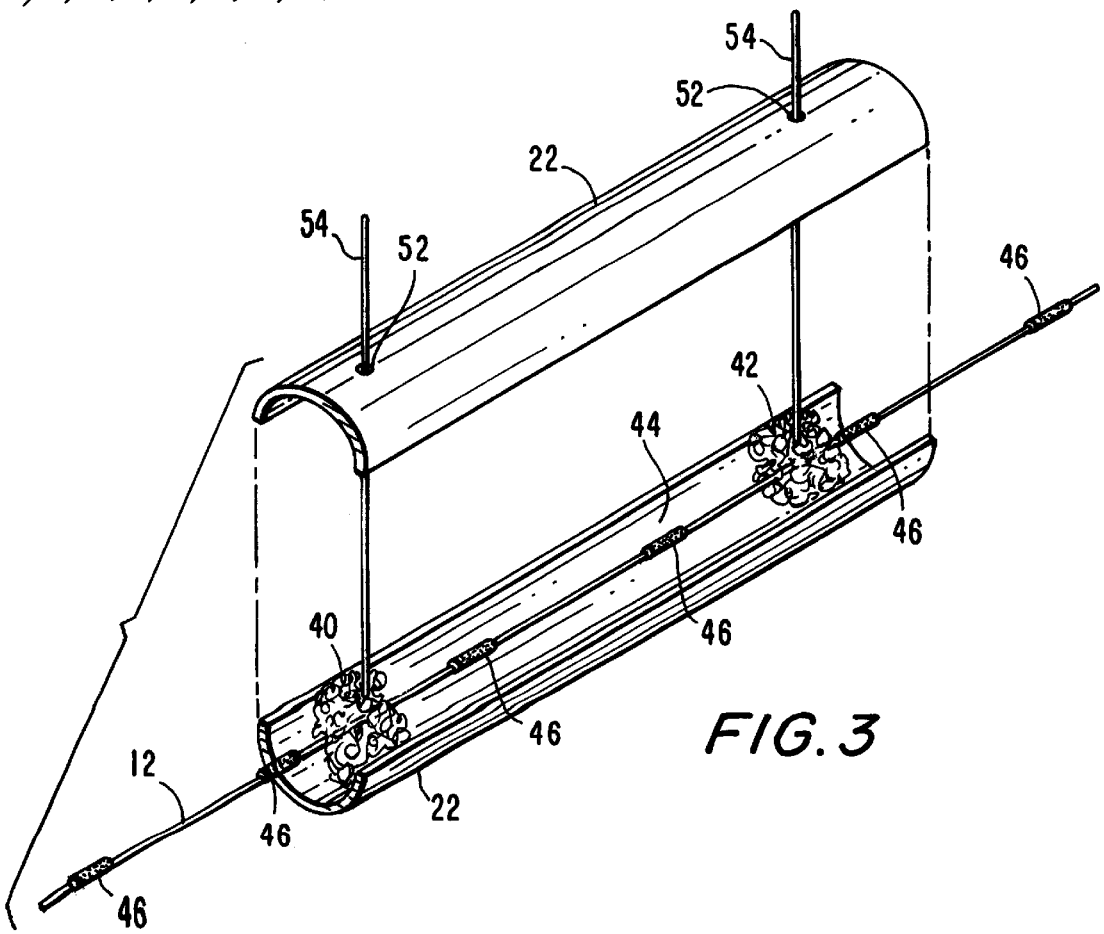
FIG. 3 is an elevation in cross section of the interior of the tubular member of the embodiment of FIG. 2.

In FIG. 1 there is shown a kite 10 flown aloft in a manner that has been known for centuries. One end of a line or string 12 is attached to the lower end of kite 10, and the lower, other end of the line is wound about a spool or reel 14 held by the person who is flying the kite. As shown in FIG. 1, a length L of the line 12 has been let out or unwound from reel 14 so that the kite is at a vertical height or altitude h. As is typical, the line 12 makes an angle 0 with the horizontal. In accordance with the present invention, as described in greater detail below with reference to FIGS. 2–3, the kite altitude-measuring apparatus, generally designated 20, computes the height h of the kite on a continuing, real-time basis, based on the measured values of the angle θ and the line length L.

Figure 2:
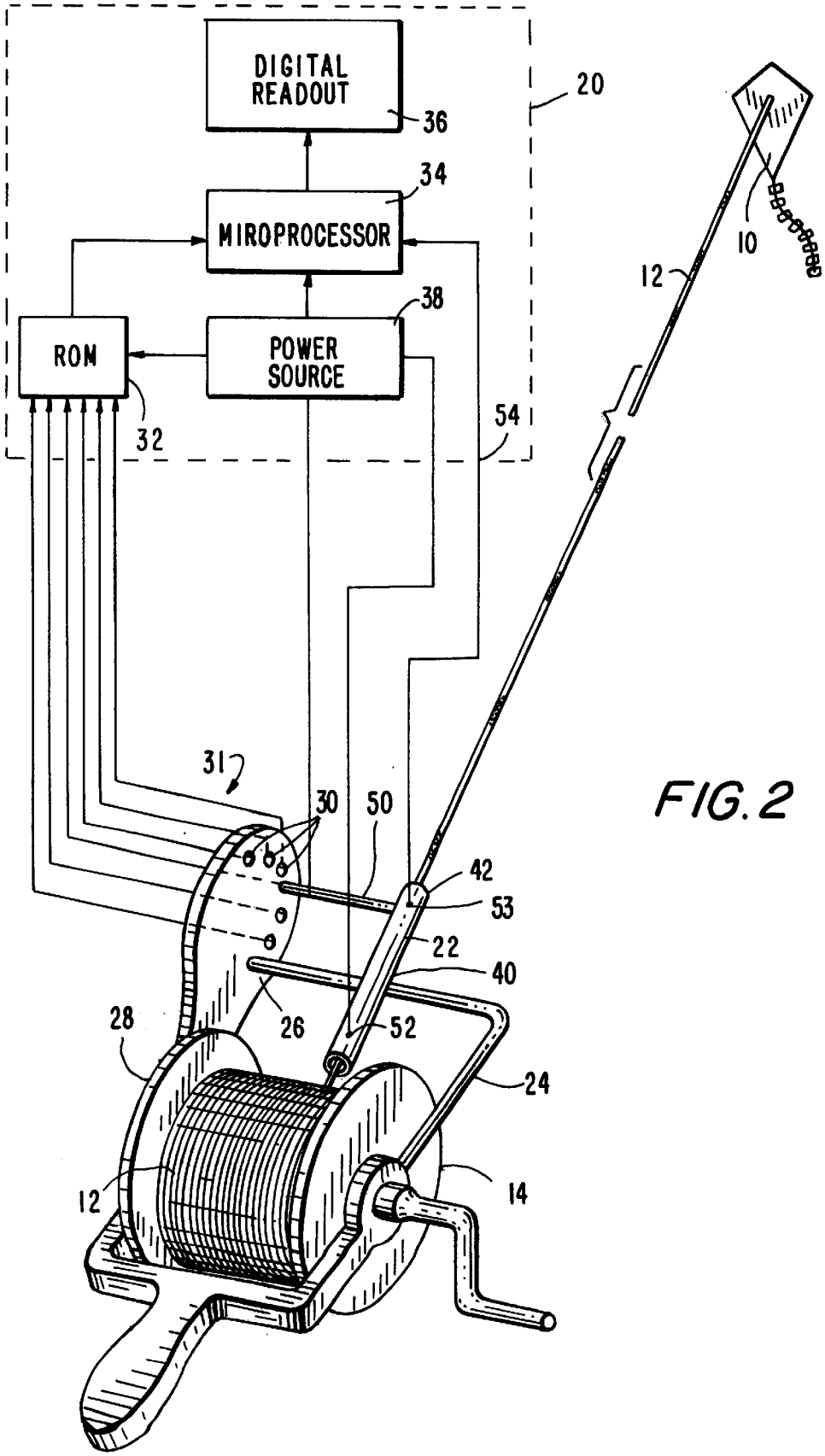
FIG. 2 is a detailed view, partly in elevation and partly schematic, of a kite altitude-measuring apparatus in accordance with an embodiment of the invention.

More specifically, as in the exemplary embodiment of the invention shown in FIG. 2, the altitude-measurement apparatus 20 includes a hollow tubular member or tube 22 pivotably mounted on an axle mount 24, the latter being attached to the reel 14 in any convenient manner. The other, free end of axle mount 24 is secured to an angular sensor, here shown in the form of an insulating board or plate 26, secured as by mounting strip 28 to the reel 14. A plurality, here shown as six in number, of conductive contacts 30 are secured in an arcuate path along the periphery of plate 26. Contacts 30 are respectively connected via leads 31 to a corresponding plurality of addresses contained in a read-only-memory (ROM) 32 that has an output coupled to a conventional microprocessor 34. The data stored in the address locations in ROM 32 represent respectively the sines of the angles made by the pivotable tubular member 22 when it pivots into electrical contact with the angularly spaced contacts 30. The output of the microprocessor 34 is connected to a conventional digital display or readout 36. A d.c. power source 38 provides the operating voltage to the ROM 32, microprocessor 34, digital readout 36 and to a contact finger 50 that is secured to and extends from the upper end of the pivotable tube 22.

The altitude-measuring apparatus 20 of the invention also includes means for measuring the length L of the line 12 that has been unwound from the reel 14 as the kite rises. To this end, as seen best in FIG. 3, in the embodiment of the invention therein disclosed, a pair of axially spaced contacts 40 and 42 are secured to an interior wall 44 of the tube 22. Contacts 40,42 may be advantageously made of steel wool or copper wool soldered, glued or otherwise securely attached to the interior wall 44. Contact 40 and finger 50 are in electrical contact with the power supply 38, the former through an opening 52 (FIGS. 2 and 3) formed in the wall of tube 22. As seen in FIG. 2, contact 42 is connected to the microprocessor 34 by means of a conductor 54 extending through an opening 53 to the interior wall 44 of tube 22. As seen best in FIG. 3, line 12, which is made of an insulating material, includes axially and equally spaced contacts or conductive coatings 46 arranged substantially along its entire length.

In operation, as the kite 10 rises, line 12 unwinds from the reel 14 and passes through the interior of tube 22. As the line 12 passes through the tube, the conductive coatings 46 on the line 12 periodically and sequentially make electrical contact with the internal tube contacts 40 and 42. As described in my co-pending application Ser. No. 08/743,854, now U.S. Pat. No. 6,253,461, each time one of the line conductive coatings 46 makes and then breaks a contact with the tube contacts 40,42, a signal is sent along line 54 to the microprocessor 34 where the number of such contacts is counted. The spacing d between the line conductive coatings 46 is known and stored in the microprocessor 34, such that the latter, based on the counted number of such contacts, is able to compute the length of the line 12 that unwinds from the reel 14 and passes through the tube 22. The line length measured in this manner corresponds to the length L (FIG. 1).

At the same time, the movement of kite line 12 through the interior of the tube 22 causes the tube to pivot about mount 24 to the angle θ that the kite 10 is at that time making with the horizontal. Depending on the magnitude of that angle, the contact finger 50 on the pivoting tube 22 makes contact with one of the contacts 30 on board 26, thereby to complete an electrical circuit that in turn causes the sine value associated with that contact 30 and thus for that angle to be addressed in and sent from ROM 32 to microprocessor 34. The microprocessor then performs the operation of multiplying the measured length L of the unwound line by the sine of the measured angle θ of the tube 22, thereby to compute the height h of the kite 10 as desired. That computed value is displayed in appropriate units, e.g. feet or meters, on the display 36.

Whereas the kite altitude-measuring apparatus has been hereinabove described with reference to a presently preferred embodiment, it will be apparent to those skilled in the art that modifications may be made therein, such as the inclusion of a bubble level to provide a reference angle that the kite line makes with the ground. It will also be apparent that such modifications may be made without departing from the spirit and scope of the present invention.

What is claimed is:

1. An apparatus for measuring the altitude of a kite attached to one end of a line, said apparatus comprising means for deriving a first line length signal corresponding to the length of line unwound as the kite rises, means for deriving a second line angle signal corresponding to the relative angular orientation of the line, said line angle signal deriving means comprising a pivotable member including a first contact and a fixed member including a plurality of angularly spaced second contacts affixed thereto and positioned relative to said pivotable member for establishing electrical contact between said first contact and one of said second contacts depending on the relative angular orientation of said pivotable member, and means coupled to said first and second signal deriving means for computing from said first and second signals a third signal representative of the altitude of the kite.

2. The apparatus of claim 1, in which said pivotable member comprises a hollow tube including said first contact, the kite line passing through said tube being effective to cause said tube to pivot, thereby to establish the relative angular orientation of said tube.

3. The apparatus of claim 1, in which said second signal deriving means further comprises means for storing specified trigonometric functions of a plurality of different angles in address locations, said address locations being operatively respectfully associated with corresponding ones of said plurality of angularly spaced second contacts.

4. The apparatus of claim 1, in which said line includes a plurality of axially spaced conductive areas thereon, said first signal deriving means including means for counting the number of said conductive areas passing through said pivotable member as the kite rises to its current position.

5. The apparatus of claim 4, in which said counting means includes axially spaced contacts secured to the interior wall of a hollow tube for sequentially contacting said line conductive areas as said line passes through said tube.

* * * * *